US005233682A

United States Patent [19]

Abe et al.

[11] Patent Number: 5,233,682

[45] Date of Patent: Aug. 3, 1993

[54] VACUUM CLEANER WITH FUZZY CONTROL

[75] Inventors: Shuji Abe; Haruo Terai; Shinji Kondoh; Yumiko Hara, all of Osaka; Seiji Yamaguchi, Shiga, all of Japan

[73] Assignee: Matsushita Electric Industrial Co., Ltd., Osaka, Japan

[21] Appl. No.: 682,280

[22] Filed: Apr. 9, 1991

[30] Foreign Application Priority Data

Apr. 10, 1990 [JP] Japan ..... 2-95703
Nov. 5, 1990 [JP] Japan ..... 2-300822

[51] Int. Cl.[5] ..... A47L 9/28; H02P 5/168

[52] U.S. Cl. ..... 395/61; 395/900; 15/319; 15/339

[58] Field of Search ..... 15/319, 339; 395/61, 395/900

[56] References Cited

U.S. PATENT DOCUMENTS

| | | | |
|---|---|---|---|
| 4,654,924 | 4/1987 | Getz et al. | 15/319 |
| 4,680,827 | 7/1987 | Hummel | 15/319 |
| 4,862,854 | 9/1989 | Oda et al. | 395/900 |
| 4,955,103 | 9/1990 | Scott et al. | 15/319 |
| 4,966,118 | 10/1990 | Itakura et al. | 395/905 |
| 5,019,979 | 5/1991 | Takahashi | 395/905 |
| 5,093,892 | 3/1992 | Orii | 388/815 |

FOREIGN PATENT DOCUMENTS

| | | |
|---|---|---|
| 264728 | 4/1988 | European Pat. Off. . |
| 312111 | 4/1989 | European Pat. Off. . |
| 347223 | 12/1989 | European Pat. Off. . |
| 0397205 | 11/1990 | European Pat. Off. . |
| 2197555 | 3/1974 | France . |
| 64-8942 | 1/1989 | Japan . |
| 161357 | 6/1989 | Japan . |
| 2063659 | 6/1981 | United Kingdom . |

OTHER PUBLICATIONS

Zadeh, "Fuzzy Logic," Computer, Apr. 1988, pp. 83-92.

*Primary Examiner*—Allen R. MacDonald
*Assistant Examiner*—George Davis
*Attorney, Agent, or Firm*—Lowe, Price, LeBlanc & Becker

[57] ABSTRACT

A vacuum cleaner with fuzzy control comprises a detector for detecting condition of sucking of dust, such as an amount of dust, a kind of dust and/or a kind of a surface of a floor to be cleaned. A fuzzy inference section responsive to the condition of sucking of dust determines an appropriate sucking force and controls the vacuum cleaner's sucking force through fuzzy inference.

18 Claims, 9 Drawing Sheets

FIG. 6

| | | DUST AMT CHG RATE | | |
|---|---|---|---|---|
| | | LARGE | NORMAL | SMALL |
| DUST AMT | SMALL | EXTREME SMALL | SMALL | RATHER SMALL |
| | NORMAL | SMALL | RATHER SMALL | NORMAL |
| | LARGE | RATHER SMALL | NORMAL | RATHER LARGE |

FIG. 7

| | | DUST AMT CHG RATE | | |
|---|---|---|---|---|
| | | LARGE | NORMAL | SMALL |
| DUST AMT | SMALL | EXTREME SMALL | SMALL | RATHER SMALL |
| | NORMAL | RATHER SMALL | NORMAL | RATHER LARGE |
| | LARGE | NORMAL | RATHER LARGE | EXTREME LARGE |

FIG. 8

| | | DUST AMT CHG RATE | | |
|---|---|---|---|---|
| | | LARGE | NORMAL | SMALL |
| DUST AMT | SMALL | EXTREME SMALL | EXTREME SMALL | SMALL |
| | NORMAL | EXTREME SMALL | RATHER SMALL | NORMAL |
| | LARGE | RATHER SMALL | RATHER SMALL | RATHER LARGE |

FIG. 9

| | | DUST AMT CHG RATE | | |
|---|---|---|---|---|
| | | LARGE | NORMAL | SMALL |
| DUST AMT | SMALL | EXTREME SMALL | SMALL | RATHER SMALL |
| | NORMAL | RATHER SMALL | NORMAL | RATHER LARGE |
| | LARGE | NORMAL | RATHER LARGE | EXTREME LARGE |

VACUUM CLEANER WITH FUZZY CONTROL

BACKGROUND OF THE INVENTION

1. Field of the Invention

This invention relates to a vacuum cleaner whose sucking force is controlled.

2. Description of the Prior Art

A vacuum cleaner is known, whose sucking force is set to about four degrees in accordance with a detected amount of dust. There is another type of a vacuum cleaner whose sucking force is set to some degrees in accordance with a floor surface condition, such as a kind, for example, a woody floor, or straw matting, and length of piles of a carpet. However, it distinguishes a floor surface into only about three degrees.

In the above-mentioned prior art there is a problem as follows:

The amount of dust on the floor and the condition of the floor cannot be distinguished into three or four degrees but it changes continuously. Thus, the sucking force should be set to a lot of degrees. However, in the above-mentioned prior art, the sucking force cannot be set optimally in accordance with the amount of dust and the condition of the floor.

SUMMARY OF THE INVENTION

The present invention has been developed in order to remove the above-described drawbacks inherent to the conventional vacuum air cleaner whose sucking force is controlled.

A vacuum cleaner with fuzzy control includes a detector for detecting a condition of sucking of dust, such as an amount of dust, a kind of dust, and/or a kind of a surface of a floor to be cleaned. A fuzzy inference section responds to the detected condition of sucking of dust by determining a sucking force through fuzzy inference.

According to the present invention there is provided a vacuum cleaner with fuzzy control, comprising: a fan motor for producing a sucking force; a power controller responsive to a sucking force control signal for controlling the sucking force; a detector for detecting condition of sucking a dust on a surface to be cleaned by application of the sucking force to the surface to produce a condition signal; and a fuzzy inference section responsive to the condition signal for producing the sucking force control signal in accordance with at least a given fuzzy inference rule.

In a vacuum cleaner with fuzzy control, as mentioned above, the fuzzy inference rule may include a given condition of an antecedent part, and a given function of a consequent part. A variable of the detected condition signal that satisfies the given condition of the antecedent part is obtained and the sucking force control signal is then determined in accordance with a result of the consequent part which is obtained by minimum-operation using the variable and the function of the consequent part.

BRIEF DESCRIPTION OF THE DRAWINGS

The object and features of the present invention will become more readily apparent from the following detailed description taken in conjunction with the accompanying drawings in which:

FIGS. 6 and 7 are tables showing rules of the sucking force;

FIGS. 8 and 9 are tables showing rules of the rotational speed of a motor of floor nozzle;

The same or corresponding elements or parts are designated as like references throughout the drawings.

DETAILED DESCRIPTION OF THE INVENTION

Hereinbelow will be described an embodiment of the invention with reference to drawings.

Figure 17:
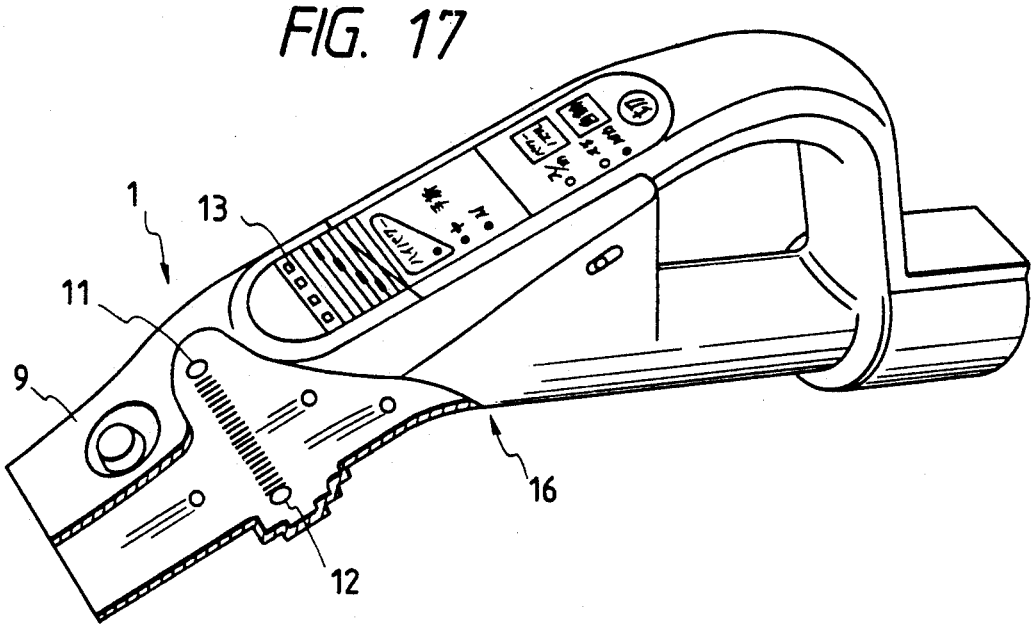
FIG. 17 is a perspective view of the handle portion.
Figure 18:
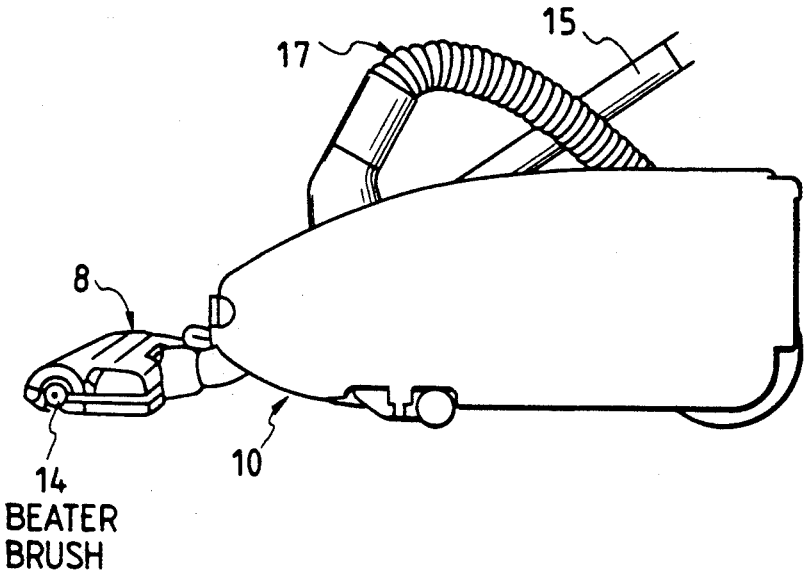
FIG. 18 is a perspective view of the embodiment of the invention.

FIG. 18 is a perspective view of the embodiment of the vacuum cleaner. A floor nozzle 8 comprises a beater brush 14 for picking up dust particles laying between piles of a carpet, which is rotated by a floor nozzle motor 19 included therein. The floor nozzle 8 is connected to a body 10 of the vacuum cleaner through an extension pipe 15, a handle portion 16, and hose 17. The body 10 comprises a fan motor 7 and a filter bag (not shown). FIG. 17 is a perspective view of a handle portion 16 with a section is cut away to show an inside view thereof. Dust particles passing through a passage of the handle portion 16, are detected by the dust sensor 1.

Figure 1:
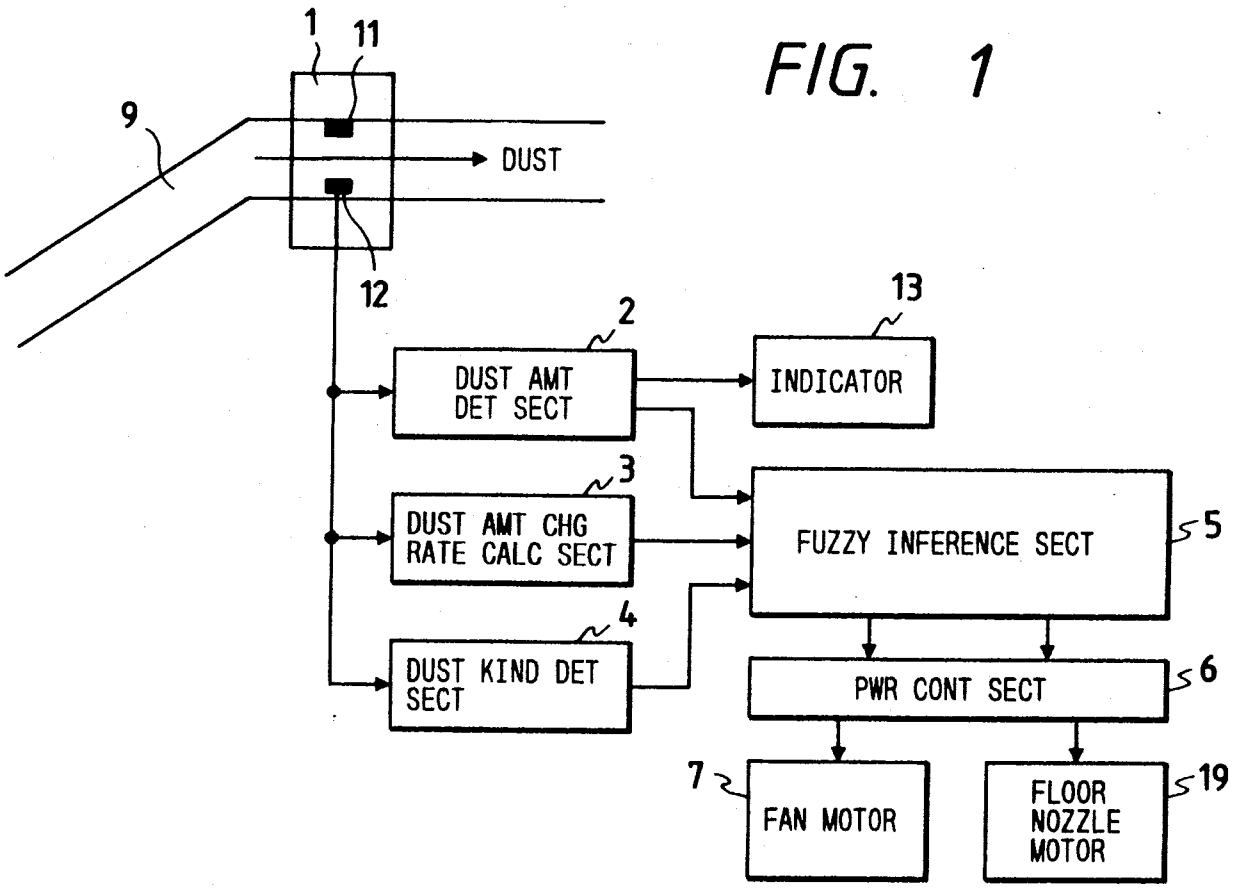
FIG. 1 is a functional block diagram of an embodiment of the invention of the vacuum cleaner with fuzzy control.

FIG. 1 is a functional block diagram of the embodiment of the invention of a vacuum cleaner with fuzzy control. In FIG. 1, a dust sensor 1 is provided in the handle portion 16. Dust sensor 1 comprises a light emitting portion 11 and a light sensitive portion 12 which are so provided that each sucked dust particle crosses a light path made therebetween. A dust signal from the dust sensor 1 is sent to a dust amount detection section 2, a dust amount change rate calculating section 3, and to a dust kind detection section 4. The dust amount detection section 2 detects an amount of dust by counting dust particles sucked for a given interval. The dust amount change rate calculating section 3 calculates a rate of change of the amount of dust for a predetermined interval. The dust kind detection section 4 detects a kind of the dust sucked, by measuring an interval needed for a dust particle passing through the light path of the dust sensor 1. Outputs of the dust amount detection section 2, the dust amount change rate calculating section 3, and a dust kind detection section 4 are sent to a fuzzy inference section 5. The fuzzy inference section 5 determines a sucking force of the fan motor 7 and a rotational speed of the motor 19 provided in the floor nozzle 8 in accordance with outputs of the dust amount detection section 2, the dust amount change rate calculation section 3, and dust kind detection section 4 through fuzzy inference. The fuzzy inference section 5 produces a fan motor control signal and a floor nozzle control signal in accordance with the inference. A power control section 6 drives the fan motor 7 and the floor nozzle 8 in accordance with the fan motor control signal and the floor nozzle control signal.

Figure 2:
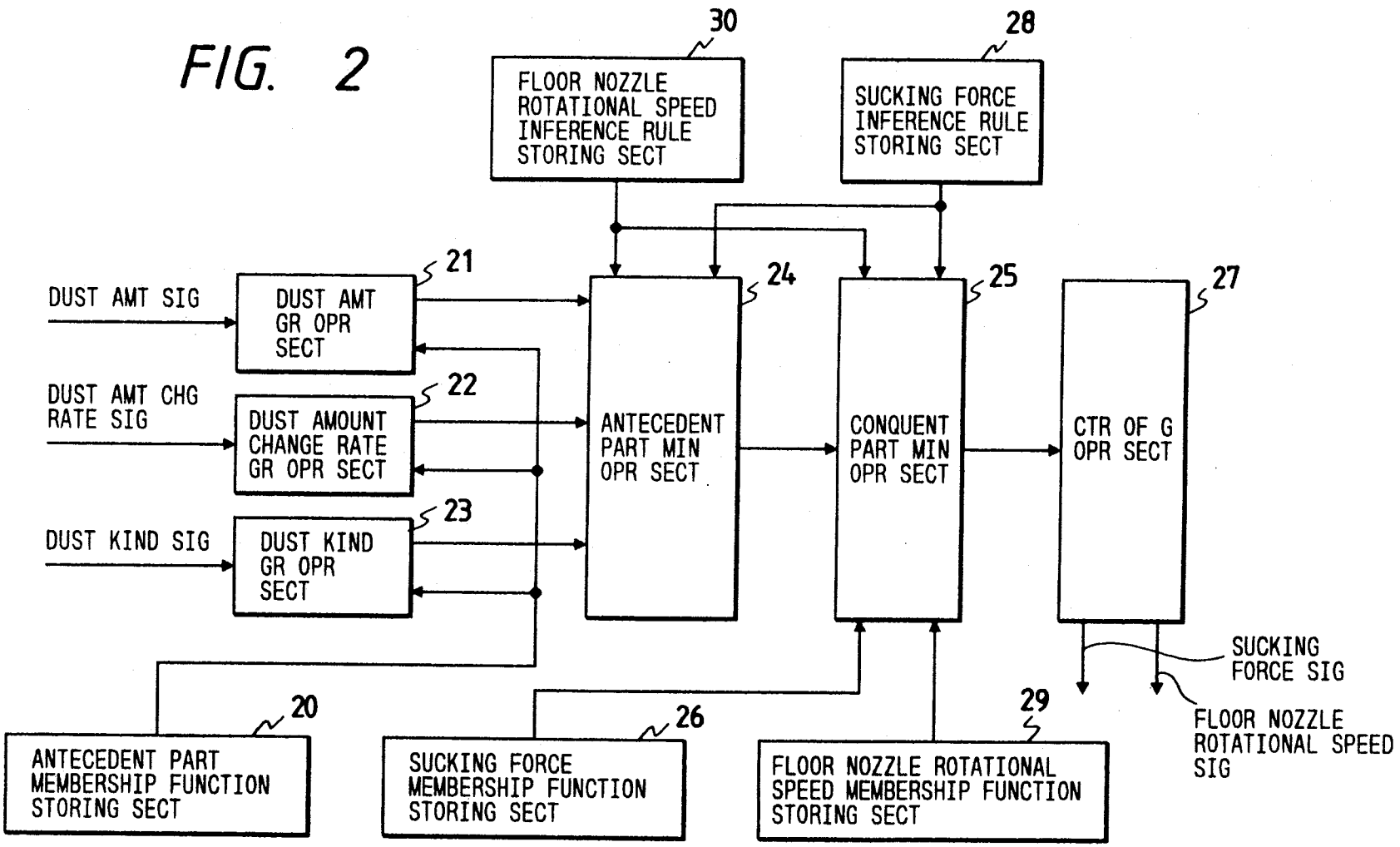
FIG. 2 is a functional block diagram of a fuzzy inference section of FIG. 1.

Structure of the above-mentioned fuzzy inference section 5 will be described more in detail. FIG. 2 is a functional block diagram of the fuzzy inference section 5. An antecedent part membership function storing section 20 stores membership functions of the amount of dust, a rate of change of the amount of dust, and a kind of dust. It sends the membership function of the amount of dust to the dust amount grade operation section 21, the membership function of the change rate of dust to a dust amount change rate grade operation section 22, and the membership function of the dust kind to a dust kind grade operation section 23. A dust amount signal from the dust amount detection section 2 is sent to the dust amount grade operation section 21 for providing a grade of the amount of dust by applying the dust amount value to the membership function of the dust amount. The dust amount change rate signal from the dust amount change rate calculating section 3 is sent to the dust amount change rate grade operation section 22 for providing a grade of the dust amount change rate by applying the dust amount change rate to the membership function of the dust change rate. The dust kind signal from the dust kind detection section 4 is sent to the dust kind grade operation section 23 for providing a grade of the dust kind by applying the dust kind signal to the membership function of the dust kind.

A dust amount grade signal from the dust amount grade operation section 21, a dust amount change rate grade signal from the dust amount change rate grade section 22, and a dust kind grade signal from the dust kind grade operation section 23 are sent to an antecedent part MIN (minimum) operation section 24. A sucking force inference rule storing section 28 stores at least one inference rule of the sucking force, which is read out, sent to, and used in the antecedent part MIN operation section 24 and the consequent part MIN operation section 25. The antecedent part MIN operation section 24 provides a result of the antecedent part of the fuzzy inference section 5 by MIN operation among the dust amount grade signal, the dust change rate grade signal, and the dust kind grade signal in accordance with each rule read from the sucking force inference rule storing section. Therefore, the number of the antecedent part results corresponds to that of the rules stored in the sucking force inference rule storing section 28. A sucking force membership function storing section 26 stores a membership function of the sucking force which is read out, sent to, and used in the consequent part MIN operation section 25. The consequent part minimum operation section 25 provides a result of the consequent part by MIN operation among each result of the antecedent part and the sucking force membership function in accordance with the inference rule stored in the sucking force inference rule storing section 28. Each result of the consequent part is sent to a center of gravity operation section 27 for defuzzification, i.e., finally determining the sucking force by calculating a center of gravity after MAX (maximum) operation among all results obtained with respect to all rules is read from the sucking force inference rule storing section 28.

The fuzzy inference section 5 can be realized readily by a microprocessor. Membership functions and inference rules stored in the antecedent membership function storing sections 20, the sucking force inference rules storing section 28, the sucking force membership function storing section 26 are optimally set in advance by leaning rules of the method of steepest descent (one of leaning rules used in a neural network) and the like from data of the sucking force of the fan motor 7 and data of the rotational speed of the floor nozzle 8 in view of the amount of dust and the rate of change in dust amount, the kind of dust, and feeling of operation during cleaning.

Similarly, the floor nozzle sucking force signal is determined. A floor nozzle rotational speed membership function storing section 29 stores a membership function of the floor nozzle rotational speed used in the consequent part minimum operation section 25. The consequent part minimum operation section 25 provides a result of the consequent part of a rule by minimum-operation among the result of the antecedent part and the floor nozzle rotational speed membership function in accordance with the inference rule stored in the floor nozzle inference rule storing section 30. Then, the consequent part minimum operation section performs MAX operation among the results of all rules to obtain a result of the consequent part. The result of the consequent part is sent to a center of gravity operation section 27 for finally determining the floor nozzle rotational speed by calculating a center of gravity.

Membership functions of the floor nozzle rotational speed inference rule storing section 30, and floor nozzle rotational membership function storing section 29 are optimally set in advance by leaning rules of the method of steepest descent (one of leaning rules used in a neural network) and the like, similarly. The power control section 6 controls the fan motor 7 and the floor nozzle 8 whose phase control amount is calculated in accordance with the determined sucking force and rotational speed to the floor nozzle.

Figure 16:
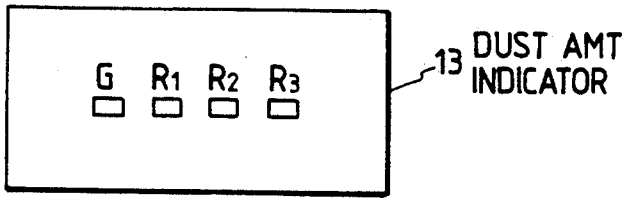
FIG. 16 is a plan view of an indicator provided to a handle portion of the cleaner.

Hereinbelow will be described operation of the above-mentioned vacuum cleaner. Light emitted from the light emitting portion 11 of the dust sensor 1 is received by the light sensitive portion 12 when there is no dust. When a dust particle passes therethrough, the light from the light emitting portion 11 is intercepted by the dust particle. Therefore, the output of the light sensitive portion 12 provides information of existence of dust. The dust amount detection section 2 accumulates a count of dust particle detected by the dust sensor 1 for a given interval (for example, 0.1 seconds). Accumulating of the dust particle provides the amount of dust on the floor at the present instance. This technique is disclosed in a European patent application No. EP 0 397 205 A1 (FIGS. 4–8). FIG. 16 is a plan view of an indicator 13 provided on the handle portion 16 as shown in FIG. 17. It comprises four LED (light emitting diode) lamps G, R1, R2, and R3. The LED lamps R1, R2, and R3 turn on in the order mentioned sequentially as the accumulating value of an amount of dust increase. If there is substantially no dust, the LED G is turned on to indicate an operator that there is no dust and effectively suggests to the operator to move to another place.

Figure 3:
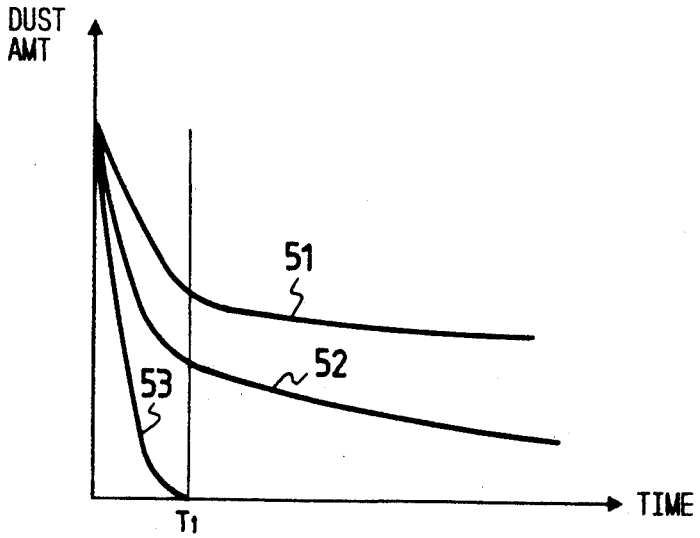
FIG. 3 shows curves of change in the dust accumulation amount.
Figure 5:
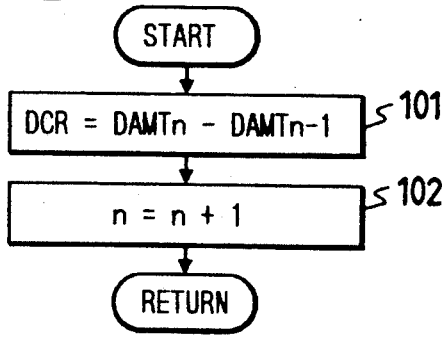
FIG. 5 shows a flow chart for obtaining change rate of the dust amount.

FIG. 3 shows change in the dust amount accumulating values for a given interval during continuously cleaning at a given place. In FIG. 3, curves 51–53 of the dust amount accumulating values show rapid decrease from beginning of cleaning to an instance T1. This means that the dust on the floor surface has been sucked almost at the instance T1. After the instance T1, tendency of change in the amount of dust is largely divided into three types as shown in FIG. 3. In the case of the curve 53, an accumulation value of the dust is almost zero after the instance T1. This means that the dust has been sucked till the instant T1 and the floor surface to be cleaned is considered as a wood floor, a cushion floor, or straw matting. In the case that a floor surface is of a carpet, there is a difficulty in sucking dust perfectly because dust particles lie between piles and the amount of dust is larger than that of the wood floor and straw matting. In such case, the change of accumulating value of the dust decreases gradually as shown by the curves 51 and 52. The rate of change in the amount of dust is calculated by the dust amount change rate calculating section 3. The rate of change in the amount of dust provides information as to which kind of characteristic the floor surface under cleaning belongs to. If a rate of change in the amount of dust is small, this means the floor surface causes difficulty in cleaning dust. If a rate of change in the amount of dust is large, this means the floor surface exhibits easiness in cleaning dust. The change rate in the amount of dust is obtained by a processing in accordance with a flow chart of FIG. 5. In FIG. 5, the dust amount change rate DCR is obtained by subtraction of an amount of dust at instance n−1 from that at an instance n in step 101. In the following step the value n is increased by one. This processing is carried at every detection of the dust amount value, i.e. at every predetermined interval for accumulating dust count. The dust amount value is obtained through the technique disclosed in the European patent application No. EP 0 397 205 A1 (FIG. 8).

Figure 4:
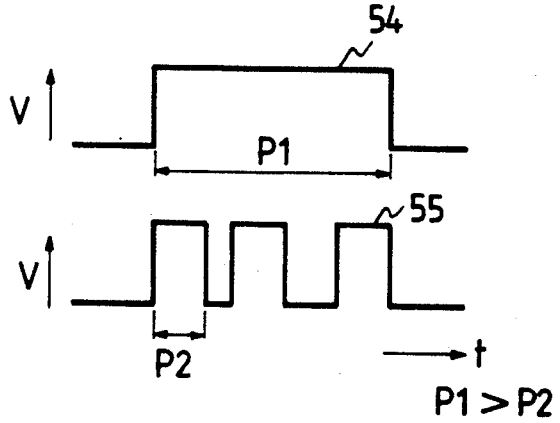
FIG. 4 shows waveforms of the dust detection signal.
Figure 10:
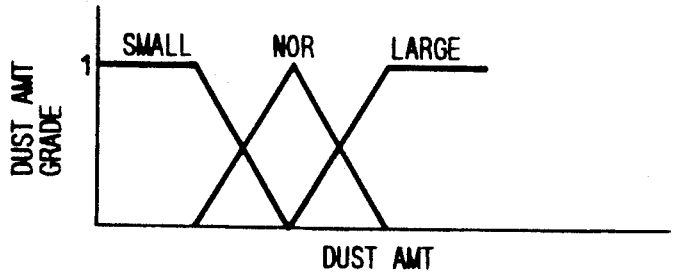
FIGS. 10–14 show membership functions used in this embodiment.

FIG. 4 shows waveforms of the dust detection signal. An waveform 54 shows a waveform of dust which is a piece of cotton, an waveform 55, an waveform of dust which is a sand grain. The dust kind detection section 4 detects a kind of dust by distinguishing whether the dust is a large and light dust particle such as a cotton dust or is a small and heavy dust particle such as a sand grain by detecting a pulse width P1 or P2. The optimum sucking force is determined by the amount of dust, the kind of dust, and a characteristic of the floor to be cleaned. It is inferred by the fuzzy inference section 5 from outputs of the dust amount detection section 2, the dust amount change rate calculating section 3 and the dust kind detection section 4. Such pulse width detection of a dust particle passing through the light path of the dust sensor 1 is disclosed in the European patent application No. EP 0 397 205 A1 (FIGS. 9 and 10).

Hereinbelow will be described processing of the inference of the sucking force. FIGS. 6–9 are tables showing rules of fuzzy inference of this embodiment. The table of FIG. 6 shows rules of the sucking force when sucked dust particles are a light and large dust particle.

The table of FIG. 7 shows rules of the sucking force when sucked dust particles are a heavy and small dust particle. The rule is such that the sucking force is set to an extremely large value when an amount of dust is large, when the dust is a small size particle such as a sand particle, and the floor shows a tendency that it is difficult of clean the dust thereon (dust amount change rate is small) as shown in FIG. 7. That is, one of rules is given by:

If the amount of dust=large, the dust amount change rate=small, and pulse width of a dust particle=small, THEN the sucking force=extreme large.

A table shown in FIG. 8 shows rules of the rotational speed of a motor 19 of the floor nozzle 8 when sucked dust particles are light and large in size. The table of FIG. 9 shows rules of the sucking force when sucked dust particles are heavy and small in size. The rule is such that the rotational speed is set to an extremely large value when an amount of dust is large, when the dust has a small size particle such as a sand particle, and the floor shows a tendency that it is difficult of clean the dust thereon (dust amount change rate is small) as shown FIG. 9. That is, it is given by:

IF the amount of dust=large, the dust amount change rate=small, and pulse width of a dust particle=small, THEN the rotational speed=extreme large.

Figure 11:
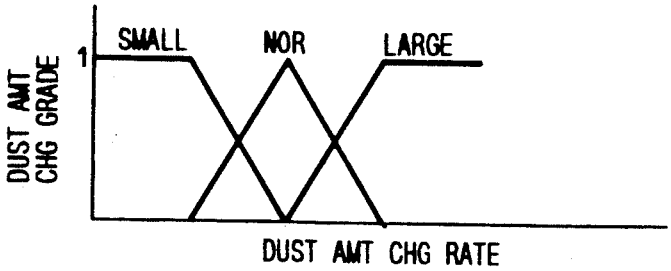
Figure 12:
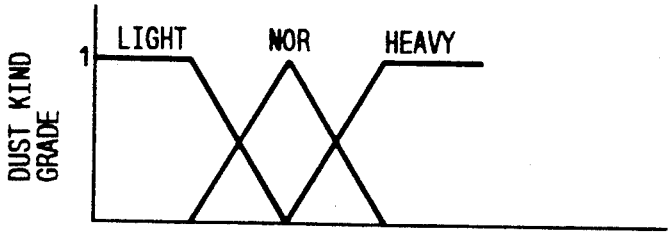
Figure 13:
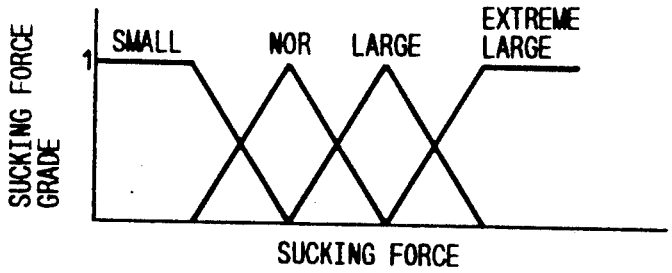
Figure 14:
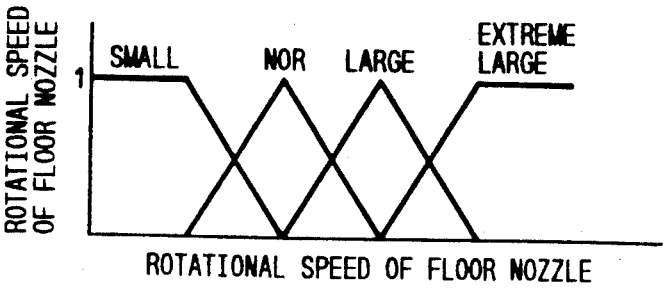

Qualitative degrees such as the amount of dust is large, the change rate in the amount of dust is small, and the sucking force is set to "extremely large" are represented quantitatively by membership functions shown in FIGS. 10–11. The dust amount grade operation section 21 obtains a dust amount grade by MAX (maximum) operation between the output of the dust amount detection section 2 and a membership function of the amount of dust stored in the membership function storing section 20. The dust amount change rate grade operation section 22 obtains a dust change rate grade similarly, by MAX operation between the output of the dust amount change rate calculation section 3 and a membership function of the dust amount change rate stored in the antecedent membership function storing section 20. The dust kind grade operation section 23 obtains a dust kind grade similarly, by MAX operation between the output of the dust kind detection section 4 and a membership function of dust kind stored in the antecedent membership function storing section 20.

In the antecedent part minimum operation section 24 obtains a result of each rule in the antecedent part by MIN (minimum) operation among three grades, namely, the dust amount grade, the dust amount change rate grade, and dust kind grade. The consequent part minimum operation section 25 obtains a result of each rule by MIN operation between the result of the antecedent part and the membership function of the sucking force of the consequent part stored in the sucking force membership function storing section 26. The consequent part minimum operation section 25 obtains a result of the consequent part by MAX operation among result of all rules.

The result of the consequent part is sent to the center of gravity operation section 27 which obtains finally the magnitude of the sucking force by MAX operating among all results and then calculating the center of gravity of all results. The power control section 6 controls by calculating the phase control amount of the fan motor 7.

Determination of the rotational speed of the motor 14 of the floor nozzle 8 is obtained by the result of the antecedent part in a manner similar to the above-mentioned processing of the determination of the sucking force. Then, the rotational speed of the motor 14 of the floor nozzle 8 is determined by the rule read from the floor nozzle rotational speed inference rule storing section 30 and the floor nozzle rotational speed membership function storing section 29.

Figure 15:
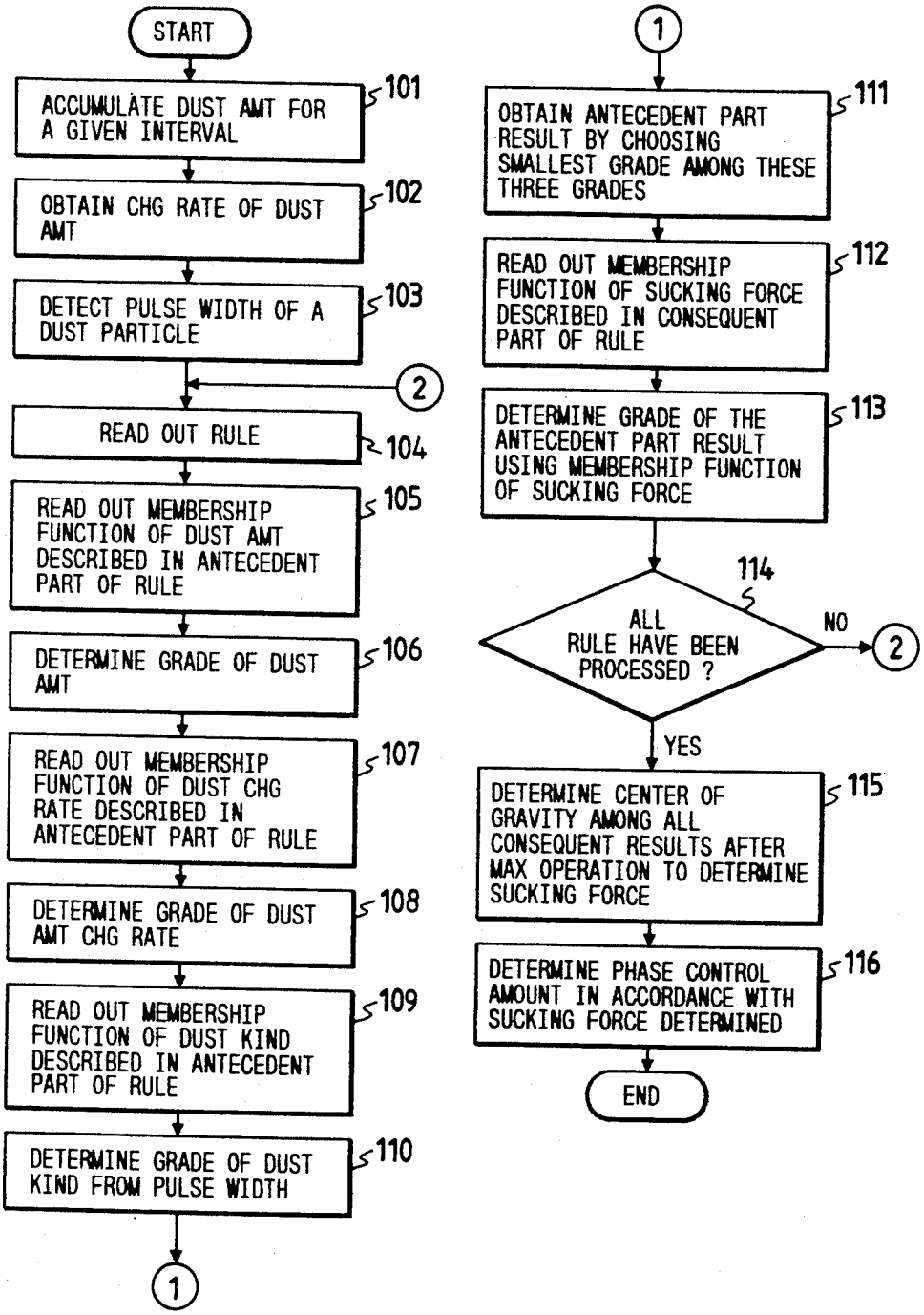
FIG. 15 is a flow chart of the embodiment.

More specifically, operation of this embodiment will be described. The above mentioned functions are performed sequentially by a microprocessor (not shown) in accordance with a flow chart shown in FIG. 15. Processing of the antecedent part is as follows:

Processing starts in step 101. In step 101, the microprocessor obtains dust accumulation amount by counting dust particles for a given interval. In the following step 102, the microprocessor obtains a rate of change of the amount of dust through processing shown in FIG. 5. In the following step 103, the microprocessor detects a pulse width of a dust particle. The microprocessor reads out one of the inference rules in the following step 104. In the succeeding step 105, the microprocessor reads out a membership function of the amount of dust, which is described in an antecedent part of the read out rule. The microprocessor determines a grade of the amount of dust in accordance with dust accumulation amount and the membership of the amount of dust in the following step 106. In the succeeding step 107, the microprocessor reads out membership function of a rate of change of the amount of dust. Then, the microprocessor determines a grade of dust amount change rate in step 108. In the succeeding step 109, the microprocessor reads out a membership function of a kind of dust. In step 110, the microprocessor determines a grade of a kind of dust from the pulse width obtained in step 103. In step 111, the microprocessor obtains the result of the antecedent part by MIN operation among these three grades, i.e., choosing the smallest value among them.

Processing of the consequent part is as follows:

In the following step 112, the microprocessor reads out the membership function of the sucking force described in the consequent part of the read out rule. In the succeeding step 113, the microprocessor determines a grade by detecting matching degree with the membership function. In the following step 114, a decision is made as to whether all rules have been processed. If NO, processing returns to step 104 and this process is carried out until the answer turns to YES, i.e., all results of all results have been obtained. If the answer is YES, processing proceeds to step 115, In step 115, the microprocessor determines a center of gravity among results of all rules after MAX operation among all consequent results. That is, the microprocessor performs a defuzzyfication. In the following step 116, the microprocessor determines the phase control amount in accordance with the determined center of gravity.

Figure 19:
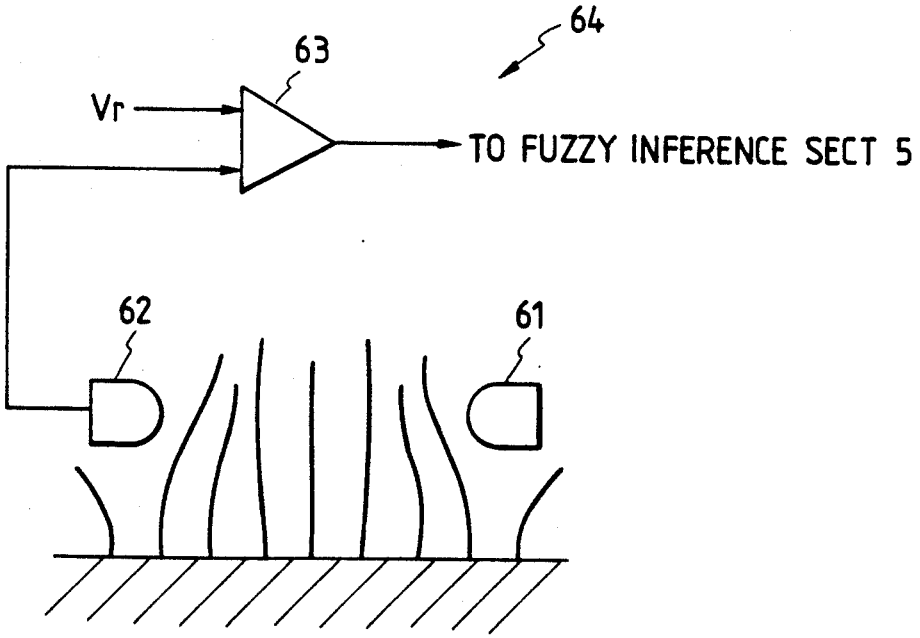
FIG. 19 is a block diagram of a modified embodiment of the invention of the vacuum cleaner.

FIG. 19 shows a modified embodiment of the invention. In FIG. 19, a floor surface kind detector 63 comprises a light emitting portion 61 emitting a light toward a light sensitive portion 62, and a comparator 63 for comparing an output of the light sensitive portion 62 with a reference signal. An output of the floor surface kind detector 64 is used for controlling the sucking force and the rotational speed of the motor in the sucking nozzle 8. Such technique is disclosed in Japanese Patent application provisional publication No. 64-8942.

In this embodiment, MAX-MIN composition method and the center of gravity method are used. However, other methods can be used. The sucking force in the consequent part is represented by a membership. However, a real number value or a linear equation can be used.

As mentioned above, the vacuum cleaner with fuzzy control of this invention provides high efficiency during cleaning because the sucking force is controlled in accordance with the amount of dust, the change rate of amount of dust, or the kind of dust through fuzzy inference. Therefore, this feature provides an excellent operational feeling because the floor nozzle does not stick to the floor due to the optimally controlled sucking force.

Moreover, if the number of input information and the number of output control increase, it is difficult to control of output, i.e., the sucking force or the rotational speed of the motor of the beater brush, with relations between these input information and relations between output controls maintained. Control of this invention is optimally provided with Fuzzy inference.

What is claimed is:

1. A vacuum cleaner with fuzzy control, comprising:

(a) a fan motor for producing a sucking force;

(b) detection means for detecting a kind of floor to be cleaned or a a kind of dust on said floor to produce at least one condition signal;

(c) a first fuzzy inference means for producing a sucking force control signal from said at least one condition signal in accordance with a first fuzzy inference rule;

(d) control means for controlling said sucking force in accordance with said sucking force control signal;

(e) a floor contacting brush for picking up said dust on said surface, said floor contacting brush being mounted in a floor nozzle of said vacuum cleaner;

(f) a drive motor for driving said floor contacting brush;

(g) second control means for controlling a rotational speed of said drive motor in response to a drive control signal; and (h) second fuzzy inference means for producing said drive control signal from said at least one condition signal in accordance with a second fuzzy inference rule.

2. A vacuum cleaner with fuzzy control as claimed in claim 1, wherein said first fuzzy inference means produces said sucking force control signal in accordance with said first fuzzy inference rule including a given condition of an antecedent part and a given function of a consequent part such that a variable of said at least one condition signal that satisfies said given condition of said antecedent part is obtained and said sucking force control signal is then determined in accordance with a result of said consequent part which is obtained by minimum-operation using said variable and said function of said consequent part.

3. A vacuum cleaner with fuzzy control as claimed in claim 1, wherein said first fuzzy inference means produces said sucking force control signal in accordance with a plurality of fuzzy inference rules, each of said plurality of fuzzy inference rules including a given condition of an antecedent part and a given function of a consequent part, such that a variable of each of said at least one plurality of fuzzy inference rules for which said condition signal satisfies said given condition of said antecedent part is obtained, then a result of each of said consequent parts is obtained by minimum-operation using said variable and said given function, and then said sucking force control signal is determined in accordance with a total result obtained by maximum-operation using all results of said consequent parts.

4. A vacuum cleaner with fuzzy control as claimed in claim 1, wherein said second fuzzy inference means produces said drive control signal in accordance with said second fuzzy inference rule including a given condition of an antecedent part and a given function of a consequent part such that a variable of said at least one condition signal that satisfies said given condition of said antecedent part is obtained and said drive control signal is then determined in accordance with a result of the consequent part which is obtained by minimum-operation using said variable and said function of said consequent part.

5. A vacuum cleaner with fuzzy control as claimed in claim 1, wherein said detection means comprises a dust sensor for detecting an amount of said dust sucked by said sucking force in a predetermined period.

6. A vacuum cleaner with fuzzy control as claimed in claim 5, further comprising means for determining a rate of change in said amount of said dust for a second predetermined period in response to an output of said dust sensor.

7. A vacuum cleaner with fuzzy control as claimed in claim 5, further comprising:

indicating means for indicating the amount of said dust detected by said dust sensor.

8. A vacuum cleaner with fuzzy control as claimed in claim 1, wherein said detection means comprises a dust sensor, and means for measuring a width of a pulse of an output of said dust sensor to determine said kind of said dust.

9. A vacuum cleaner with fuzzy control as claimed in claim 1, wherein said detection means comprises floor sensor means for sensing said kind of floor to be cleaned, said floor sensor means having a light emitting portion and a light sensitive portion so arranged to receive a light beam from said light emitting portion, said floor sensor means being part of said floor nozzle of said vacuum cleaner such that piles of a carpet on said floor to be cleaned intercept said light beam.

10. A method of vacuum cleaning, comprising:

producing a sucking force;

detecting at least two conditions of a surface to be cleaned by application of said sucking force to said surface, said at least two conditions of said surface being selected from the group consisting of: an amount of dust sucked by said sucking force when applied to said surface, a rate of change in the amount of dust sucked by said sucking force when applied to said surface, a kind of dust detected when said sucking force is applied to said surface, and a kind of said surface to be cleaned;

applying at least one fuzzy inference rule to the detected conditions to determine a preferred sucking force and a preferred rotational speed;

controlling said sucking force in accordance with the determined preferred sucking force; and rotating a brush in contact with said surface to be cleaned at said preferred rotational speed.

11. A method of vacuum cleaning as in claim 10, wherein:

said fuzzy inference rule includes a given condition as an antecedent part and a given function for use as a consequent part; and said step of applying at least one fuzzy inference rule comprises:

(i) obtaining a variable of at least one of said detected conditions that satisfies said given condition, and (ii) applying said given function of said consequent part to said variable to determine said preferred sucking force.

12. A method of vacuum cleaning as in claim 10, wherein:

said fuzzy inference rule comprises a plurality of rules each of which includes a given condition as an antecedent part and a given function for use as a consequent part; and said step of applying a fuzzy inference rule comprises:

for each of said plurality of rules, obtaining a variable of at least one of said detected conditions that satisfies the given condition of the rule, and applying the given function of the rule to said variable to determine a result for each rule, and obtaining said preferred sucking force from the results for all of said plurality of rules.

13. A method of vacuum cleaning as in claim 10, wherein:

said fuzzy inference rule includes a given condition as an antecedent part and a given function for use as a consequent part; and said step of applying at least one fuzzy inference rule comprises:

(i) obtaining a variable of at least one of said detected conditions that satisfies said given condition, and (ii) applying said given function of said consequent part to said variable to determine said preferred rotational speed.

14. A method of vacuum cleaning as in claim 10, wherein:

said fuzzy inference rule comprises a plurality of rules each of which includes a given condition as an antecedent part and a given function for use as a consequent part; and said step of applying a fuzzy inference rule comprises:

for each of said plurality of rules, obtaining a variable of at least one of said detected conditions that satisfies the given condition of the rule, and applying the given function of the rule to said variable to determine a result for each rule, and obtaining said preferred rotational speed from the results for all of said plurality of rules.

15. A method of vacuum cleaning, comprising:

applying a sucking force to a surface to be cleaned;

detecting a condition of dust on said surface to be cleaned;

applying a fuzzy inference rule to the detected condition to determine a preferred rotational speed; and rotating a brush in contact with said surface to be cleaned at said preferred rotational speed.

16. A vacuum cleaner with fuzzy control, comprising:

(a) means for applying a sucking force to a surface to be cleaned;

(b) means for detecting at least two conditions of a surface to be cleaned by application of said sucking force to said surface, said at least two conditions of said surface being selected from the group consisting of: an amount of dust sucked by said sucking force when applied to said surface, a rate of change in the amount of dust sucked by said sucking force when applied to said surface, a kind of dust detected when said sucking force is applied to said surface, and a kind of said surface to be cleaned;

(c) fuzzy inference means for applying a fuzzy inference rule to the detected conditions to determine a preferred sucking force and a preferred rotational speed;

(d) means for controlling application of said sucking force in accordance with the determined preferred sucking force;

(e) a floor contacting brush for picking up said dust on said surface; and (f) means for driving said floor contacting brush at said preferred rotational speed.

17. A vacuum cleaner with fuzzy control as in claim 16, wherein: said fuzzy inference means applies a first fuzzy inference rule to the detected conditions to produce a first control signal, and said means for driving said floor contacting brush rotate the floor contacting brush at a speed which is a function of said first control signal.

18. A vacuum cleaner with fuzzy control as in claim 17, wherein said fuzzy inference means applies a second fuzzy inference rule to the detected conditions to produce a second control signal, and said means for controlling application of said sucking force control the sucking force as a function of said second control signal.

* * * * *